US010071579B2

(12) United States Patent
Aoki

(10) Patent No.: US 10,071,579 B2
(45) Date of Patent: Sep. 11, 2018

(54) PRINTING APPARATUS WITH ACCESS PORTIONS FOR ACCESS TO INSIDE OF HOUSING

(71) Applicant: RISO KAGAKU CORPORATION, Tokyo (JP)

(72) Inventor: Kazuyuki Aoki, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/581,314

(22) Filed: Apr. 28, 2017

(65) Prior Publication Data

US 2017/0341441 A1 Nov. 30, 2017

(30) Foreign Application Priority Data

May 26, 2016 (JP) ..... 2016-105157

(51) Int. Cl.
*B41J 29/02* (2006.01)
*B41J 29/13* (2006.01)

(52) U.S. Cl.
CPC ..... *B41J 29/02* (2013.01); *B41J 29/13* (2013.01)

(58) Field of Classification Search
CPC ..... B41J 29/02; B41J 29/13
See application file for complete search history.

(56) References Cited

U.S. PATENT DOCUMENTS 5,355,160 A * 10/1994 Ozawa ..... B41J 29/02 346/145
6,280,018 B1 8/2001 Belon et al.
9,302,516 B2 4/2016 Osakabe et al.
2004/0206767 A1* 10/2004 Haney ..... B41J 2/16585 221/9
2008/0094987 A1 4/2008 Oshida et al.
2009/0274342 A1 11/2009 Wu et al.
2012/0293583 A1 11/2012 Kemma et al.
2015/0258800 A1 9/2015 Tanaka et al.

FOREIGN PATENT DOCUMENTS

EP 2 487 041 8/2012
JP 2004-130578 4/2004

OTHER PUBLICATIONS

Extended European Search Report for EP 17171261.5 dated Oct. 9, 2017.

* cited by examiner

*Primary Examiner* — Jason Uhlenhake

(74) *Attorney, Agent, or Firm* — Greenblum & Bernstein, P.L.C.

(57) ABSTRACT

A printing apparatus includes a plurality of components for the printing apparatus, and a housing configured to house the plurality of components in an inside of the housing and having a plurality of access portions used by a user and a service man to access the inside of the housing. The access portions have predetermined difficulty levels of access of accessing the inside of the housing from the access portions respectively. At least one or more of the plurality of components housed in the inside of the housing are arranged based on positions and the predetermined difficulty levels of access of the access portions and a frequency of access to the at least one or more of the plurality of components by the user and the service man.

18 Claims, 8 Drawing Sheets

PRINTING APPARATUS WITH ACCESS PORTIONS FOR ACCESS TO INSIDE OF HOUSING

CROSS REFERENCE TO RELATED APPLICATION

This application is based upon and claims the benefit of priority from the prior Japanese Patent Application No. 2016-405157, filed on May 26, 2016, the entire contents of which are incorporated herein by reference.

BACKGROUND

1. Technical Field

The disclosure relates to a printing apparatus including a housing.

2. Related Art

A housing of a printing apparatus is provided with a door and the like which a person such as a user uses to access components of the printing apparatus housed in the housing in various operations, maintenance, and the like.

In a printing apparatus of Japanese Unexamined Patent Application Publication No. 2004-130578, a housing is provided with an operation panel which functions as a door for accessing parts in a control area of an apparatus upper portion and with a front door for accessing parts in an ink area on a front side of an apparatus lower portion. Moreover, this printing apparatus further includes a partition door which partitions a drive system area on a back side and the ink area on the front side in the apparatus lower portion, and from which parts in the drive system area can be accessed.

SUMMARY

In the printing apparatus described above, the user has to open the front door and the partition door to access the parts in the drive system area. Accordingly, the parts in the drive system area are more troublesome for the user to access than the parts in the control area which can be accessed by just opening the operation panel and the parts in the ink area which can be accessed by just opening the front door.

As described above, the components in the housing of the printing apparatus sometimes vary in accessibility depending on the positions thereof.

The user and a service man who performs maintenance and the like of the printing apparatus are main persons who access the components in the housing of the printing apparatus. Meanwhile, in general, not all of the components are accessed evenly at the same frequency by either of the user and the service man.

Accordingly, there may be a case where specific components to be accessed frequently by the user and service man, respectively, are arranged at positions with low accessibility. Hence, depending on the arrangement of the components in the housing, the convenience of the printing apparatus may be decreased in terms of the accesses to the components.

An object of the disclosure is to provide a printing apparatus improved in convenience in cases where a user and a service man access components in a housing of the printing apparatus.

A printing apparatus in accordance with some embodiments includes a plurality of components for the printing apparatus, and a housing configured to house the plurality of components in an inside of the housing and having a plurality of access portions used by a user and a service man to access the inside of the housing. The access portions have predetermined difficulty levels of access of accessing the inside of the housing from the access portions respectively. At least one or more of the plurality of components housed in the inside of the housing are arranged based on positions and the predetermined difficulty levels of access of the access portions and a frequency of access to the at least one or more of the plurality of components by the user and the service man.

In the configuration described above, it is possible to reduce occurrence of a situation where the components of the printing apparatus to be accessed by the user and the service man are arranged at positions with low accessibility. As a result, the convenience in cases where the user and the service man access the components in the housing of the printing apparatus can be improved.

The housing may include two divided housings divided in a front-rear direction of the printing apparatus. The plurality of access portions may include a front face of the housing, a rear face of the housing, a side face of the housing, and an opening-closing portion between the two divided housings. The predetermined difficulty levels of access of the access portions may decrease in an order of the opening-closing portion, the side face, the rear face, and the front face. A first component of the plurality of components necessary for the user to access may be arranged at a position suitable for access from the front face or a position suitable for access from the rear face, depending on the difficulty levels of access of the front face and the rear face and the frequency of access to the first component by the user. A second component of the plurality of components necessary for the service man to access and not being an access target of the user may be arranged at any of a position suitable for access from the rear face, a position suitable for access from the side face, and a position suitable for access from the opening-closing portion, depending on the difficulty levels of access of the rear face, the side face, and the opening-closing portion and the frequency of access to the second component by the service man.

In the configuration described above, the component which needs to be accessed by the user is arranged at the position suitable for access from the front face or the rear face of the housing with low difficulty levels of access, depending on the difficulty levels of access of these access portions and the frequency of access to the component by the user. The user can thereby easily access the component which needs to be accessed, and the convenience for the user is thus improved. Moreover, the component which needs to be accessed by the service man and which is not the access target of the user is arranged at any of positions suitable for access from access portions other than the front face of the housing with the lowest difficulty level of access, depending on the difficulty levels of access of the access portions and the frequency of access to the component by the service man. Accordingly, it is possible to suppress unnecessary access to the components by the user while improving the convenience for the service man. Hence, the configuration described above can suppress unnecessary access to the components in the housing of the printing apparatus while improving the convenience in cases where the user and the service access the components.

DETAILED DESCRIPTION

Figure 1:
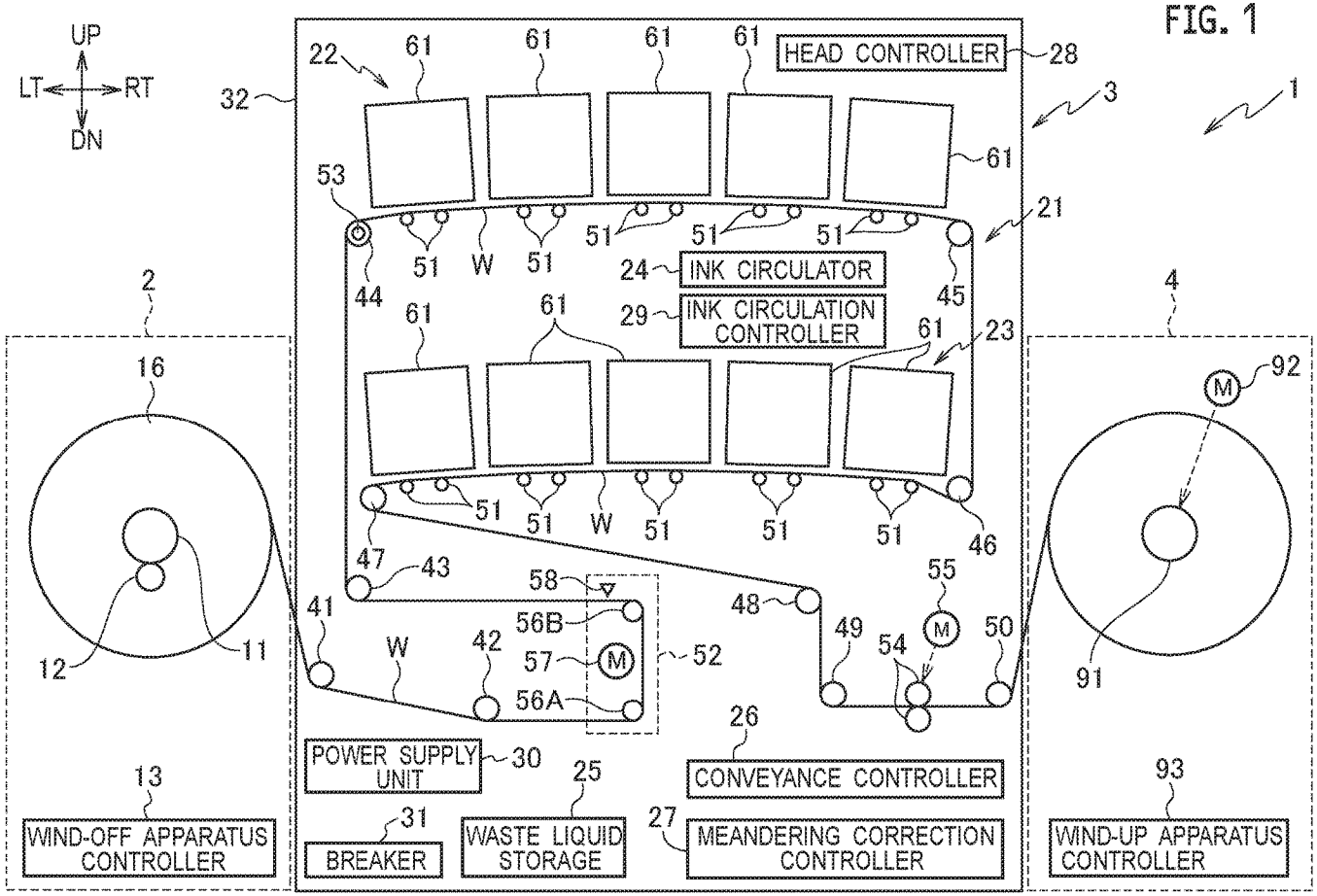
FIG. 1 is a schematic configuration diagram of a printing system in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be herein below provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
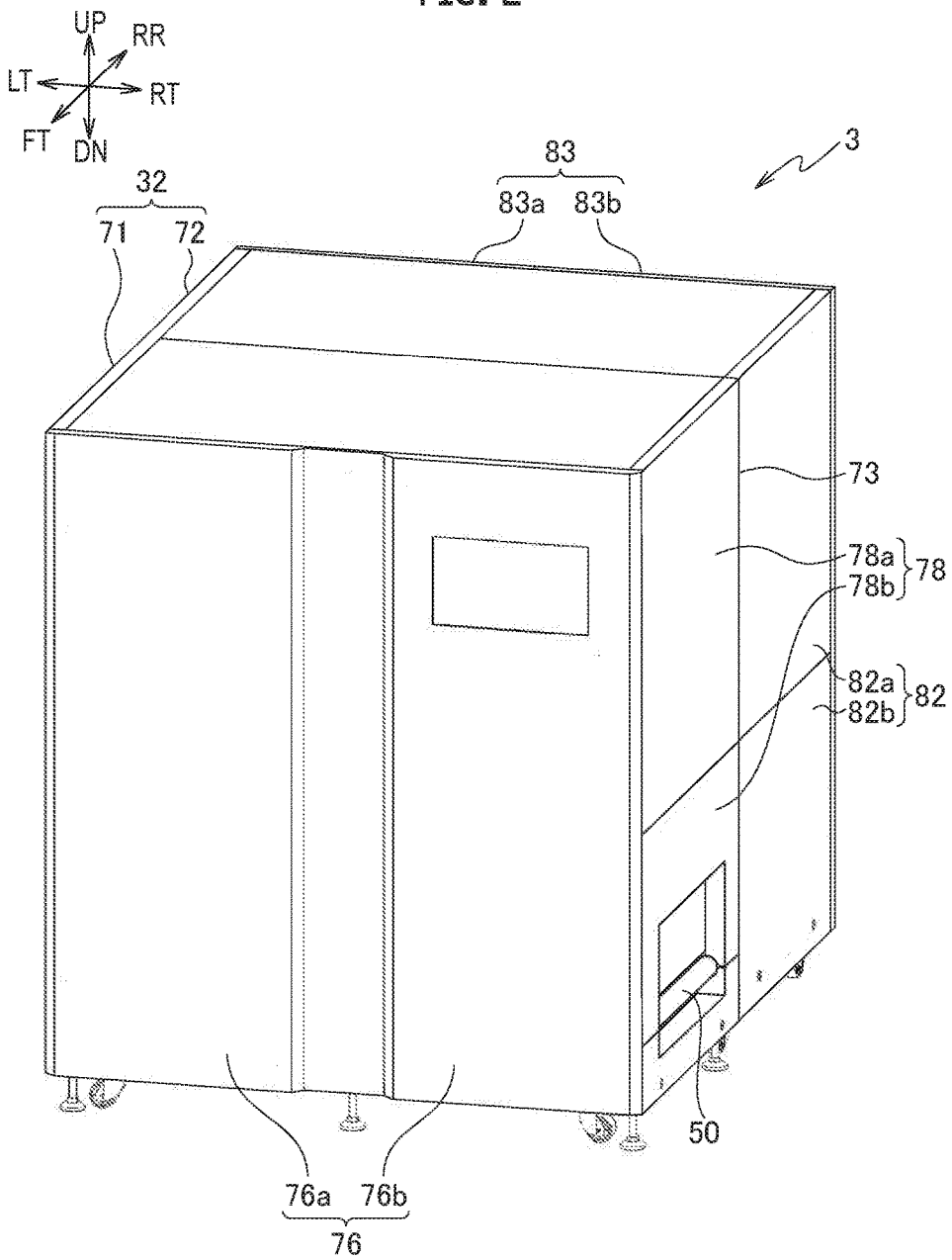
FIG. 2 is a front perspective view of a printing apparatus in the embodiment.
Figure 3:
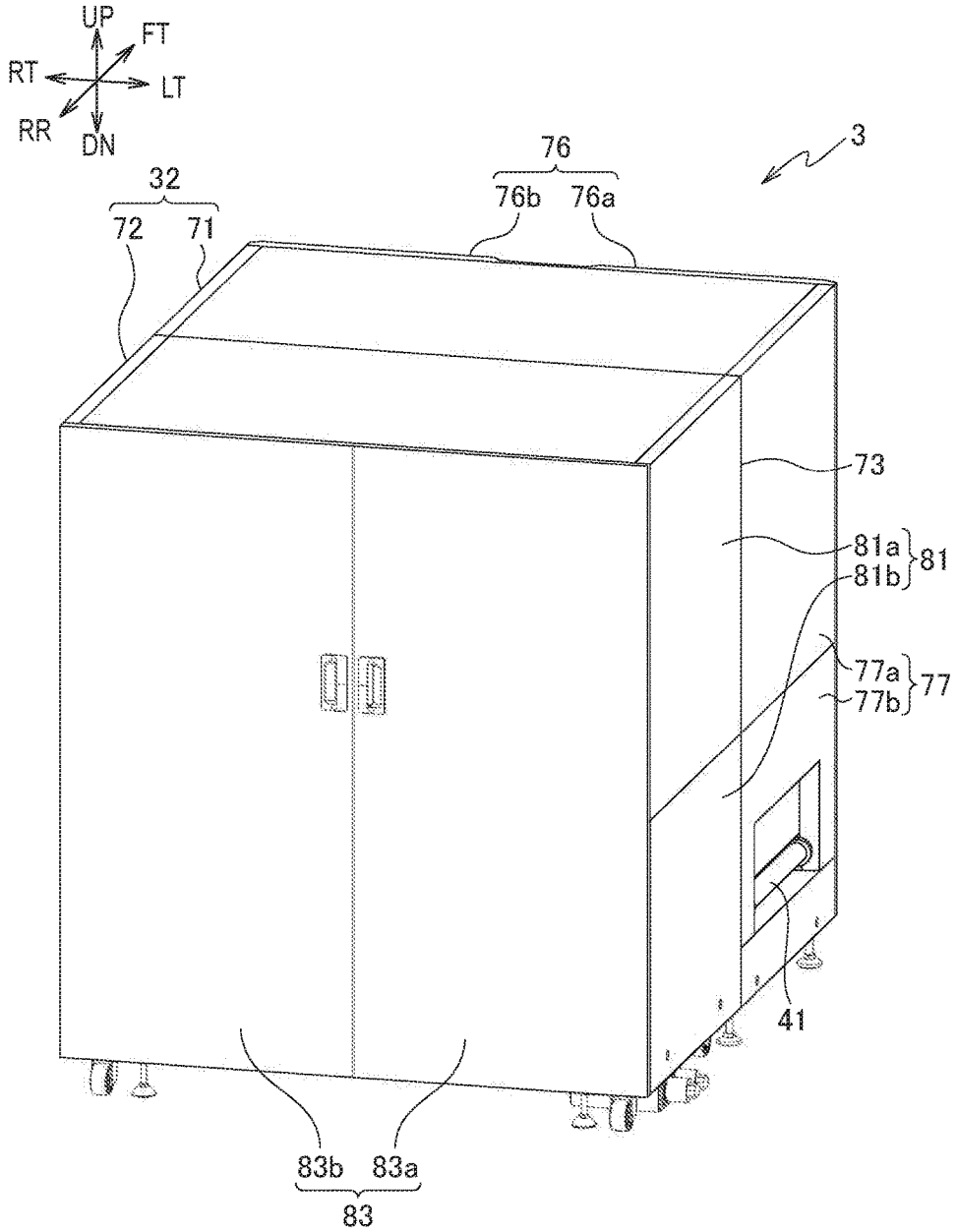
FIG. 3 is a rear perspective view of the printing apparatus in the embodiment.
Figure 4:
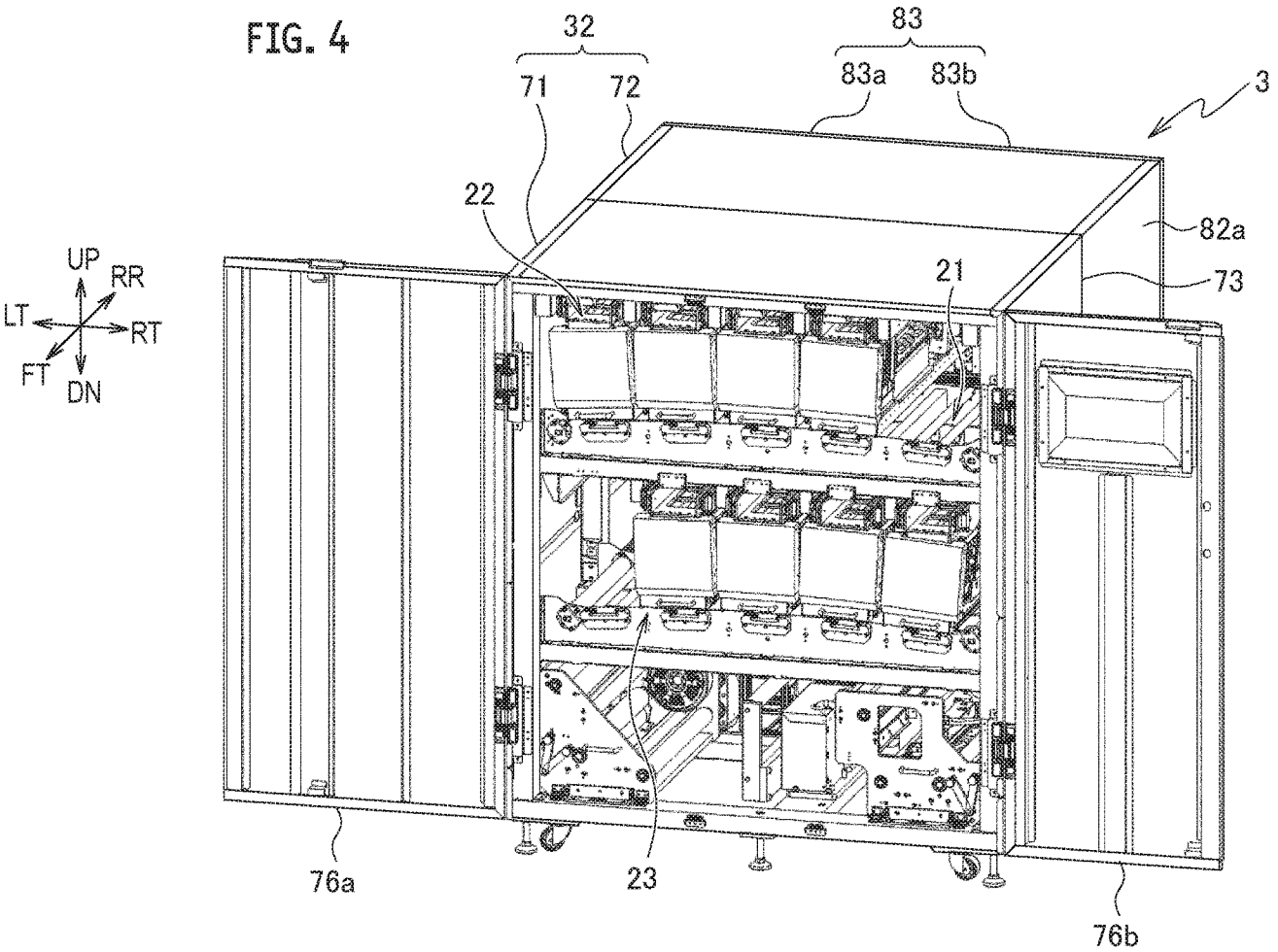
FIG. 4 is a perspective view of a state where front doors of the printing apparatus in the embodiment are opened.
Figure 5:
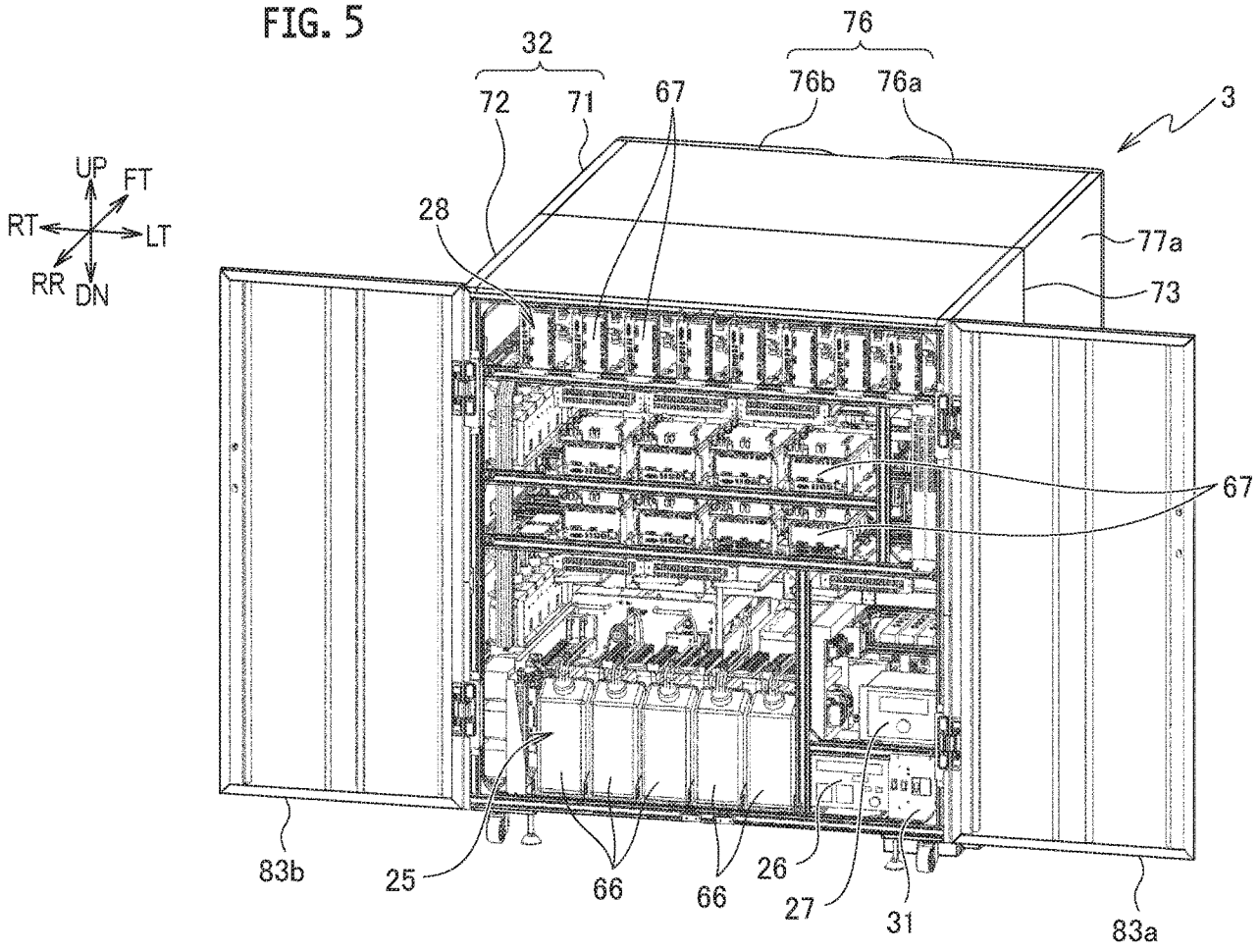
FIG. 5 is a perspective view of a state where rear doors of the printing apparatus in the embodiment are opened.
Figure 6:
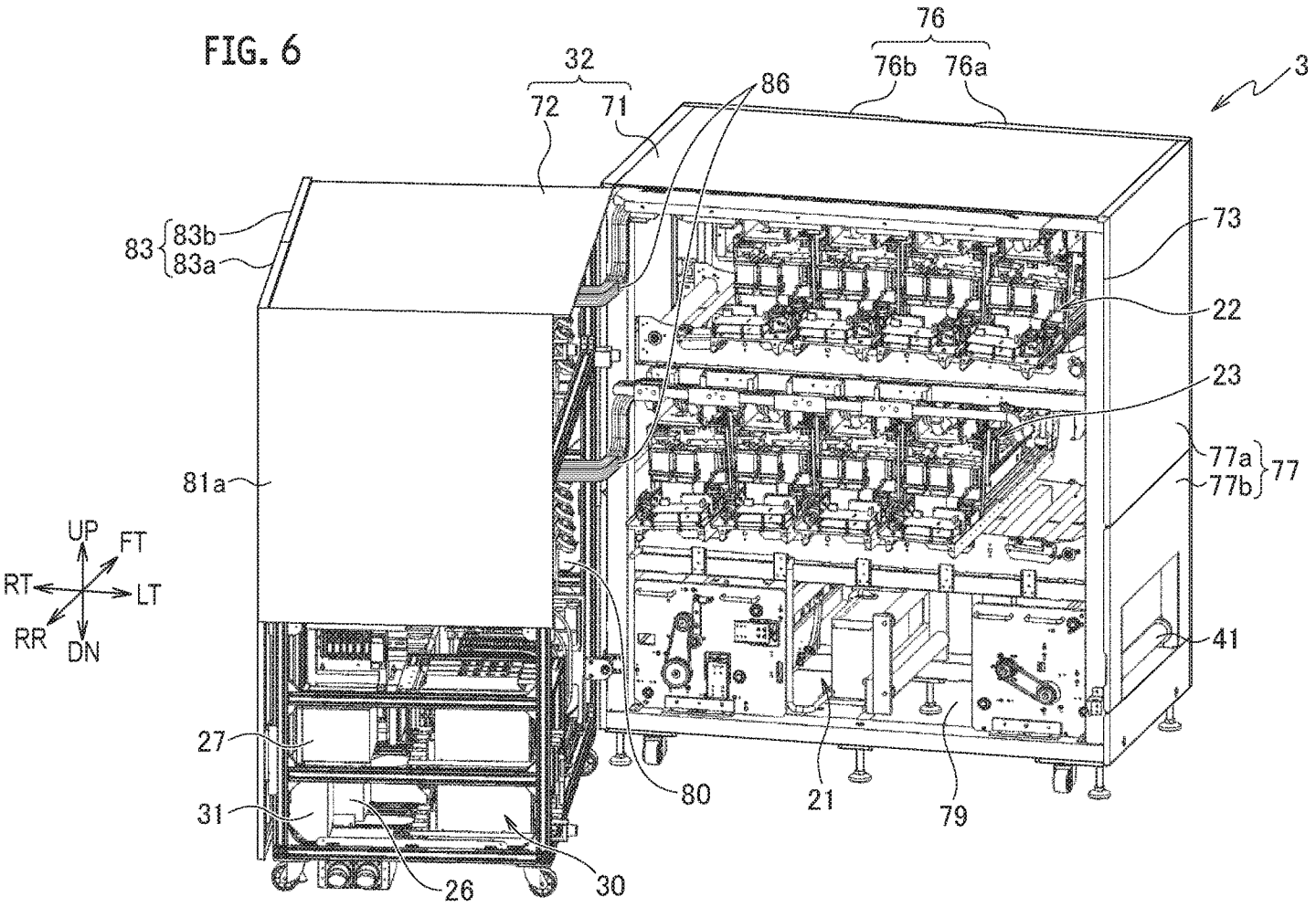
FIG. 6 is a perspective view of a state where a space is opened between a main body housing and an electric component housing of the printing apparatus in the embodiment and a side cover in a lower portion of a left face of the electric component housing is removed.
Figure 7:
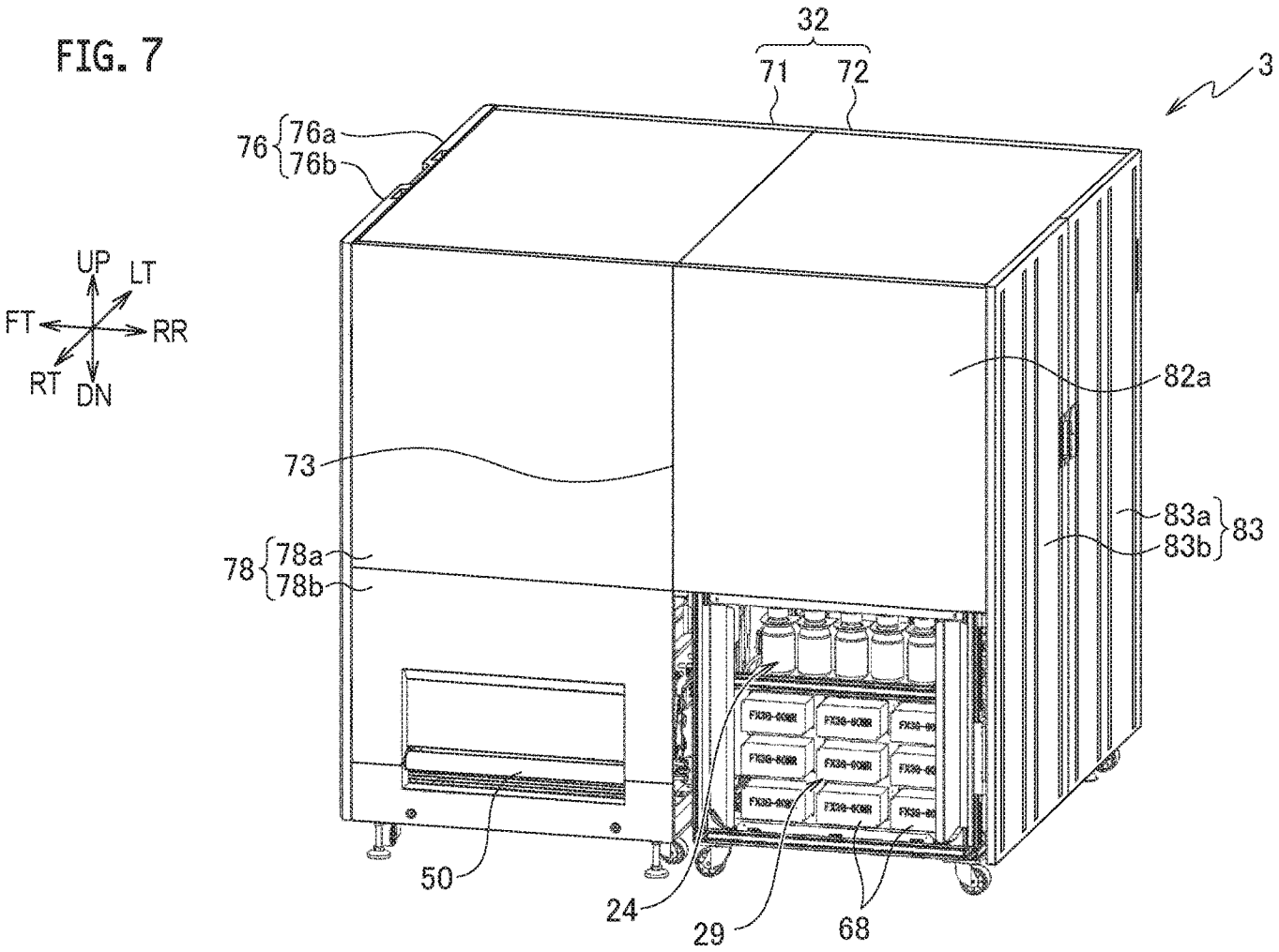
FIG. 7 is a perspective view of a state where a side cover in a lower portion of a right face of the electric component housing is removed in the printing apparatus in the embodiment.
Figure 8:
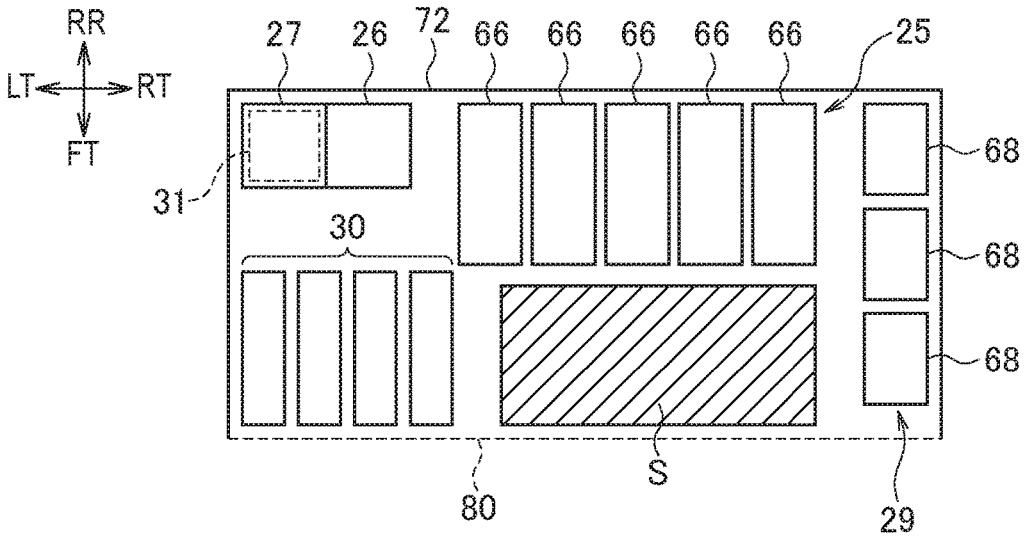
FIG. 8 is a schematic view for explaining an arrangement of units in a lower portion of the electric component housing in the printing apparatus in the embodiment.

FIG. 1 is a schematic configuration diagram of a printing system 1 including a printing apparatus 3 in an embodiment of the present invention. FIG. 2 is a front perspective view of the printing apparatus 3. FIG. 3 is a rear perspective view of the printing apparatus 3. FIG. 4 is a perspective view of a state where front doors 76*a* and 76*b* of the printing apparatus 3 are opened. FIG. 5 is a perspective view of a state where rear doors 83*a* and 83*b* of the printing apparatus 3 are opened. FIG. 6 is a perspective view of a state where a space is opened between a main body housing 71 and are electric component housing 72 of the printing apparatus 3 and a side cover 81*b* in a lower portion of a left face 81 of the electric component housing 72 is removed. FIG. 7 is a perspective view of a state where a side cover 82*b* in a lower portion of a right face 82 of the electric component housing 72 in the printing apparatus 3 is removed. FIG. 8 is a schematic view for explaining an arrangement of units in a lower portion of the electric component housing 72 in the printing apparatus 3. In FIGS. 1 to 8, right, left, up, down, front, and rear are denoted by RT, LT, UP, DN, FT, and RR, respectively.

As illustrated in FIG. 1, the printing system 1 includes a wind-off apparatus 2, the printing apparatus 3, and a wind-up apparatus 4.

The wind-off apparatus 2 winds off a web W being a long print medium made of film, paper, or the like to the printing apparatus 3. The wind-off apparatus 2 includes a web roll support shaft 11, a brake 12, and a wind-off apparatus controller 13.

The web roll support shaft 11 rotatably supports a web roll 16. The web roll support shaft 11 is formed in a long shape extending in a front-rear direction. The web roll 16 is a roll of the web W.

The brake 12 applies brake to the web roll support shaft 11. Tension is thereby applied to the web W between the web roll 16 and a pair of conveyance rollers 54 of the printing apparatus 3 to be described later.

The wind-off apparatus controller 13 controls brake force of the brake 12 to adjust the tension applied to the web W. The wind-off apparatus controller 13 includes a CPU, a RAM, a ROM, a hard disk, and the like.

The printing apparatus 3 prints images on the web W wound off from the wind-off apparatus 2 while conveying the web W. The printing apparatus 3 includes a conveyor 21, a first printer 22, a second printer 23, an ink circulator 24, a waste liquid storage 25, a conveyance controller 26, a meandering correction controller 27, a head controller 28, an ink circulation controller 29, a power supply unit 30, a breaker 31, and a housing 32.

The conveyor 21 conveys the web W wound off from the wind-off apparatus 2. The conveyor 21 includes guide rollers 41 to 50, twenty under-head support members 51, a meandering corrector 52, an encoder 53, the pair of conveyance rollers 54, and a conveyance motor 55.

The guide rollers 41 to 50 guide the web W conveyed in the printing apparatus 3. The guide rollers 41 to 50 rotate by following the conveyed web W. The guide rollers 41 to 50 are formed in a long shape extending in the front-rear direction.

The guide rollers 41 and 42 guide the web W between the wind-off apparatus 2 and the meandering corrector 52. The guide roller 41 s arranged near a left face of the housing 32 in a lower portion of the printing apparatus 3. The guide roller 42 is arranged between the guide roller 41 and a meandering correction roller 56A of the meandering corrector 52 to be described later.

The guide rollers 43 to 49 guide the web W between the meandering corrector 52 and the pair of conveyance rollers 54. The guide roller 43 is arranged on the left of a meandering correction roller 56B of the meandering corrector 52 to be described later. The guide roller 44 is arranged above the guide roller 43. The guide roller 45 is arranged on the right of the guide roller 44 at the same height as the guide roller 44. The guide roller 46 is arranged below the guide roller 45 and above the guide roller 43. The guide roller 47 is arranged on the left of the guide roller 46, near and on the right of the web W between the guide rollers 43 and 44, at substantially the same height as the guide roller 46. The guide roller 48 is arranged on the lower right side of the guide roller 47. The guide roller 49 is arranged below and slightly on the right of the guide roller 48.

The guide roller 50 guides the web W between the pair of conveyance rollers 54 and the wind-up apparatus 4. The guide roller 50 is arranged near a right face of the housing 32 in the lower portion of the printing apparatus 3.

The under-head support members 51 support the web W under the first printer 22 and the second printer 23. The under-head support members 51 are formed in a long shape extending in the front-rear direction. Ten under-head support members 51 are arranged in each of an area between the guide rollers 44 and 45 which is under the first printer 22 and an area between the guide rollers 46 and 47 which is under the second printer 23.

The ten under-head support members 51 in each of the area between the guide rollers 44 and 45 and the area between the guide rollers 46 and 47 are arranged in an arch shape protruding upward. The web W is thereby tensioned and maintained in a stable posit on between the guide rollers 44 and 45 and between the guide rollers 46 and 47.

The meandering corrector 52 corrects meandering of the web W. The meandering corrector 52 includes the meandering correction rollers 56A and 56B, a meandering correction motor 57, and a web sensor 58.

The meandering correction rollers 56A, and 56B are rollers for guiding the web W and correcting the meandering of the web W. The meandering correction rollers 56A and 56B are formed in a long shape extending in the front-rear direction. The meandering correction rollers 56A and 56B are each configured such that the angle of the axial direction of the meandering correction roller to the front-rear direction on a horizontal plane can be adjusted. The meandering correction roller 56A is arranged on the right of the guide roller 42. The meandering correction roller 56B is arranged above the meandering correction roller 56A.

The meandering correction motor 57 turns the meandering correction rollers 56A and 56B about an axis orthogonal to the horizontal plane to adjust the angles of axial directions of the meandering correction rollers 56A and 56B to the front-rear direction on the horizontal plane.

The web sensor 58 detects the positions of edges of the web W in the front-rear direction to correct the meandering. The web sensor 58 is arranged near the meandering correction roller 56B.

The encoder 53 is connected to the guide roller 44 and outputs a pulse signal every time the guide roller 44 rotates by a predetermined angle. The pulse signal outputted from the encoder 53 is used to control conveyance speed of the web W.

The pair of conveyance rollers 54 convey the web W toward the wind-up apparatus 4 while nipping the web W. The pair of conveyance rollers 54 are arranged between the guide rollers 49 and 50.

The conveyance motor 55 rotationally drives the conveyance rollers 54.

The first printer 22 prints images on a front side of the web W. The first printer 22 is arranged above the web W between the guide rollers 44 and 45. The first printer 22 includes five head units 61.

The head units 61 include inkjet heads (not illustrated) and elect inks from nozzles of the inkjet heads. The five head units 61 of the first printer 22 eject inks of different colors, respectively.

The second printer 23 prints images on a back side of the web W. The second printer 23 is arranged above the web W between the guide rollers 46 and 47. The second printer 23 includes five head units 61 configured to eject inks of different colors, respectively, like the first printer 22.

The ink circulator 24 supplies the inks to the inkjet heads of the head units 61 while circulating the inks along ink circulation routes. The ink circulator 24 includes the ink circulation route, an ink cartridge configured to supply the ink to the ink circulation route, and the like for each of the head units 61. An ink tank configured to store the supplied ink, an ink pump configured to feed the ink for the circulation of the ink, and the like are provided in each of the ink circulation routes. The ink circulator 24 also includes a drive board configured to drive the ink pumps and the like.

The waste liquid storage 25 stores the inks discharged in cleaning of the inkjet heads in the head units 61 as waste liquid. As illustrated in FIG. 5, multiple waste liquid tanks 66 are provided in the printing apparatus 3 for the inks of the respective colors in the first and second printers 22 and 23.

The conveyance controller 26 controls drive of the conveyance motor 55. The conveyance controller 26 includes a CPU, a RAM, a ROM, a hard disk, and the like.

The meandering correction controller 27 controls drive of the meandering correction motor 57. The meandering correction controller 27 includes a CPU, a RAM, a ROM, a hard disk, and the like.

The head controller 28 includes multiple head control units 67 as illustrated in FIG. 5. The head control units 67 control drive of the inkjet heads in the head units 61. The head control units 67 each include a CPU, a RAM, a ROM, a hard disk, and the like.

The ink circulation controller 29 includes multiple ink circulation control units 68 as illustrated in FIG. 7. The ink circulation control units 68 control drive of the pumps and the like of the ink circulator 24. The ink circulation control units 68 each include a CPU, a RAM, a ROM, a hard disk, and the like.

The power supply unit 30 is a unit configured to supply power supplied from the mains to the units of the printing apparatus 3.

The breaker 31 is at unit configured to cut the power supply to the printing apparatus 3 when a current exceeding an allowable current flows.

The housing 32 houses multiple components of the printing apparatus 3 except for the housing 32. Specifically, the housing 32 houses the conveyor 21, the first printer 22, the second printer 23, the ink circulator 24, the waste liquid storage 25, the conveyance controller 26, the meandering correction controller 27, the head controller 28, the ink circulation controller 29, the power supply unit 30, and the breaker 31. The housing 32 also houses wires connecting the units and the like.

As illustrated in FIGS. 2 to 7, the housing 32 is divided into the main body housing 71 and the electric component housing 72 in the front-rear direction. The main body housing 71 and the electric component housing 72 are connected to each other and configured to be closeable and openable in the horizontal direction at a center opening-closing portion (opening-closing portion) 73 which is a boundary portion between the main body housing 71 and the electric component housing 72. Note that the main body housing 71 and the electric component housing 72 correspond to divided housings.

As illustrated in FIG. 4, the main body housing 71 houses the conveyor 21, the first printer 22, and the second printer 23. The main body housing 71 is formed in a hollow rectangular solid shape. A front face 76 of the main body housing 71 is configured to be closeable and openable by the front doors 76*a* and 76*b*. A left face 77 of the main body housing 71 is formed of side covers 77*a* and 77*b* detachably attached by screws. A right face 78 of the main body housing 71 is formed of side covers 78*a* and 78*b* detachably attached by screws. A rear side of the main body housing 71 is open and an opening portion 79 is formed.

As illustrated in FIGS. 5 to 7, the electric component housing 72 houses the ink circulator 24, the waste liquid storage 25, the conveyance controller 26, the meandering correction controller 27, the head controller 28, the ink circulation controller 29, the power supply unit 30, and the breaker 31. The electric component housing 72 is arranged behind the main body housing 71. The electric component housing 72 is formed in a hollow rectangular solid shape with the same height and width as the main body housing 71. The electric component housing 72 is open on the front side and an opening portion 80 is formed. The left face 81 of the electric component housing 72 is formed of side covers 81*a* and 81*b* detachably attached by screws. The right face 82 of the electric component housing 72 is formed of side covers 82*a* and 82*b* detachably attached by screws. A rear face 83 of the electric component housing 72 is configured to be operable and closeable by the rear doors 83*a* and 83*b*.

In the housing 32, the front face 76 of the main body housing 71, the left face 77 of the main body housing 71, the right face 78 of the main body housing 71, the left face 81 of the electric component housing 72, the right face 82 of the electric component housing 72, the rear face 83 of the electric component housing 72, and the center opening-closing, portion 73 are access portions used by a user and a service man to access the inside of the housing 32. Note that the front face 76 of the main body housing 71 corresponds to the front face of the housing 32. The left face 77 of the main body housing 71, the right face 78 of the main body housing 71, the left face 81 of the electric component housing 72, and the right face 82 of the electric component housing 72 correspond to the side faces of the housing 32. The rear face 83 of the electric component housing 72 corresponds to the rear face of the housing 32.

The wind-up apparatus 4 winds up the web W subjected to printing in the printing apparatus 3. The wind-up apparatus 4 includes a wind-up shaft 91, a wind-up motor 92, and a wind-up apparatus controller 93.

The wind-up shaft 91 winds up and holds the web W. The wind-up shaft 91 is formed in a long shape extending in the front-rear direction.

The wind-up motor 92 rotates the wind-up shaft 91 clockwise in FIG. 1. The wind-up shaft 91 winds up the web W by being rotated.

The wind-up apparatus controller 93 controls drive of the wind-up motor 92. The wind-up apparatus controller 93 includes a CPU, a RAM, a ROM, a hard disk, and the like.

Next, the arrangement of the components of the printing apparatus 3 in the housing 32 is described.

In the printing apparatus 3, components to be accessed by at least the user or the service man are arranged based on the posit on and difficulty level of access of each of the access portions in the housing 32 and on frequency of access to each of the components by the user and the service man. In this description, the user is a person (general user) who uses the printing apparatus 3 on a daily basis, and the service man is a person who performs maintenance and the like on the printing apparatus 3 as appropriate.

The difficulty level of access of each access portion in the housing 32 is predetermined based on a difficulty level of work of accessing the inside of the housing 32 from this access portion. The difficulty level of access of each access portion in the housing 32 is set to one of four levels of A to D which are in the descending order of difficulty of access.

An access portion with the difficulty level of access of D from which the inside of the housing 32 can be most easily accessed is the front face 76 of the main body housing 71. Since the inside of the housing 32 can be accessed from the front face 76 of the main body housing 71 only by opening the front doors 76*a* and 76*b*, the difficulty level of access of the front face 76 is the lowest.

An access portion with the difficulty level of access of is the rear face 83 of the electric component housing 72. In order to access the inside of the housing 32 from the rear face 83 of the electric component housing 72, the user or the service man has to go behind the printing apparatus 3 and open the rear doors 83*a* and 83*b*. Accordingly, the difficulty level of access of the rear face 83 of the electric component housing 72 is set higher than that of the front face 76 of the main body housing 71.

Access portions with the difficulty level of access of B are the left face 77 of the main body housing 71, the right face 78 of the main body housing 71, the left face 81 of the electric component housing 72, and the right face 82 of the electric component housing 72. In order to access the inside of the housing 32 from these side faces, the side covers 77*a*, 77*b*, 78*a*, 78*b*, 81*a*, 81*b*, 82*a*, and 82*b* fixed by screws have to be removed. Accordingly, the difficulty level of access of these side faces are set higher than difficulty levels of access of the front face 76 of the main body housing 71 and the rear face 83 of the electric component housing 72.

An access portion with the difficulty level of access of A is the center opening-closing portion 73. In order to access the inside of the housing 32 from the center opening-closing portion 73, it is necessary to release a lock and open a space between the main body housing 71 and the electric component housing 72. Accordingly, the difficulty level of access of the center opening-closing portion 73 is set higher than those of the other access portions.

In the printing apparatus 3 in which the difficulty level of access of each access portion is set as described above, a component which needs to he accessed by the user and whose frequency of access by the user is high is arranged at a position suitable for access from the front face 76 of the main body housing 71 with the difficulty level of access of D, regardless of the frequency of access by the service man.

Specifically, as illustrated in FIG. 4, the conveyor 21, the first printer 22, and the second printer 23 are arranged in the main body housing 71 at suitable positions which can be accessed by opening the front doors 76*a* and 76*b* of the main body housing 71.

For example, the user accesses the conveyor 21, the first printer 22, and the second printer 23 upon setting the web W. Specifically, the user pushes the head units 61 of the first and second printers 22 and 23 rearward. Then, the user sets the web W along a conveyance route formed by the guide rollers 41 to 50, the meandering correction rollers 56A and 56B, the under-head support members 51, and the conveyance rollers 54. Moreover, the user adjusts the position of the web sensor 58 depending on the width of the set web W.

A component which needs to be accessed by the user but whose frequency of access by the user is low is arranged at a position suitable for access from the rear face 83 of the electric component housing 72 with the difficulty level of access of C, regardless of the frequency of access by the service man. Moreover, a component which is not an access target of the user and is thus not accessed by the user but whose frequency of access by the service main is high is also arranged at a position suitable for access from the rear face 83 of the electric component housing 72 with the difficulty level of access of C.

Specifically, as illustrated in FIG. 5, the waste liquid storage 25, the conveyance controller 26, the meandering correction controller 27, the head controller 28, and the breaker 31 are arranged at suitable positions which can be accessed by opening the rear doors 83*a* and 83*b* of the electric component housing 72. In other words, the waste liquid storage 25, the conveyance controller 26, the meandering correction controller 27, the head controller 28, and the breaker 31 are arranged in a rear interior portion of the electric component housing 72.

The user accesses the waste liquid storage 25 to discard the waste liquid when any of the waste liquid tanks 66 is full. The user accesses the conveyance controller 26 to change the conveyance speed of the web W by the conveyance rollers 54. The user accesses the meandering correction controller 27 to adjust parameters such as response speed, adjustment amount, and the like of the meandering corrector 52. The user accesses the breaker 31 to turn on the breaker 31 when it is turned off. The user needs to access the waste liquid storage 25, the conveyance controller 26, the meandering correction controller 27, and the breaker 31.

The head controller 28 is accessed for an ink ejection test and the like of the inkjet heads of the head units 61. The service man accesses the head controller 28, and the user does not.

A component which is not an access target of the user and is thus not accessed by the user and whose frequency of access by the service main is a medium level is arranged at a position suitable for access from any of the left face 77 of the main body housing 71, the right face 78 of the main body housing 71, the left face 81 of the electric component housing 72, and the right face 82 of the electric component housing 72 with the difficulty level of access of B.

Specifically, as illustrated in FIG. 7, the ink circulation controller 29 is arranged at a suitable position which can be accessed by removing the side cover 82*b* in the lower portion of the right face 82 of the electric component housing 72. In other words, the ink circulation controller 29 is arranged in a right end portion of a lower interior portion of the electric component housing 72. For example, when the ink circulator 24 fails to supply the inks to the inkjet heads, the service man accesses the ink circulation controller 29 for repair.

The wires (not illustrated) of the power supply unit 30 are arranged at suitable positions which can be accessed by removing the side cover 81*b* in the lower portion of the left face 81 of the electric component housing 72 in other words, the wires of the power supply unit 30 are arranged in a left end portion of the lower interior portion of the electric component housing 72. When the power supply unit 30 is detached and attached, the service man accesses the wires of the power supply unit 30 to rewire them.

A component which is not an access target of the user and is thus not accessed by the user and whose frequency of access by the service main is low is arranged at a position suitable for access from the center opening-closing portion 73 with the difficulty level of access of A. In this case, access from the center opening-closing portion 73 is performed from the opening portion 79 on the rear side of the main body housing 71 or the opening portion 80 on the front side of the electric component housing 72 by opening a space between the main body housing 71 and the electric component housing 72 at the center opening-closing portion 73. Accessing the space opened between the main body housing 71 and the electric component housing 72 is also included in the access from the center opening-closing portion 73.

Specifically, as illustrated in FIG. 8, the power supply unit 30 is arranged at a position suitable for access from the opening portion 80 on the front side of the electric component housing 72. In other words, the power supply unit 30 is arranged in a front interior portion of the electric component housing 72. The service man accesses the power supply unit 30 to detach and attach the power supply unit 30.

The ink pumps and the drive board of the ink circulator 24 are arranged in a region S illustrated in FIG. 8 which is at a position suitable for access from the opening portion 80 on the front side of the electric component housing 72. In other words, the ink pumps and the drive board of the ink circulator 24 are arranged in the front interior portion of the electric component housing 72. For example, when the ink pumps fail, the service man accesses the ink pumps for repair and the like. For example, when short circuit occurs in the drive board, the service man accesses the drive board for repair and the like.

As illustrated in FIG. 6, wires 86 between the main body housing 71 and the electric component housing 72 are laid at positions which can be suitably accessed from the opening portion 79 on the rear side of the main body housing 71, the opening portion 80 on the front side of the electric component housing 72, and the space between main body housing 71 and the electric component housing 72. The wires 86 include wires for electrically connecting the components in the main body housing 71 and the components in the electric component housing 72 in the printing apparatus 3 an pipes forming the ink circulation routes of the ink circulator 24. For example, when the components in the housing 32 of the printing apparatus 3 are to be replaced, the service man accesses the wires 86 to perform rewiring.

Next, operations in printing by the printing system 1 are described.

When the printing is performed in the printing system 1, first, the wind-off apparatus 2, the printing apparatus 3, and the wind-up apparatus 4 start conveyance of the web W. Specifically, the wind-off apparatus controller 13 activates the brake 12, the conveyance controller 26 of the printing apparatus 3 starts the drive of the conveyance motor 55, and the wind-up apparatus controller 93 starts the drive of the wind-up motor 92. This causes the web W to be conveyed from the wind-off apparatus 2 to the wind-up apparatus 4. Applying brake to the web roll support shaft 11 with the brake 12 of the wind-off apparatus 2 causes the web W to be conveyed with tension applied to the web W between the web roll 16 and the conveyance rollers 54.

Moreover, the ink circulation controller 29 of the printing apparatus 3 starts an ink circulation operation by the ink circulator 24.

After the conveyance of the web W and the ink circulation operation are started, the head controller 28 of the printing apparatus 3 controls the inkjet heads of the head units 61 in the first and second printers 22 and. 23 to print images on the web W.

During the conveyance of the web W, the conveyance controller 26 of the printing apparatus 3 calculates the conveyance speed of the web W based on the pulse signal outputted from the encoder 53. Then, the conveyance controller 26 controls the current to be supplied to the conveyance motor 55 such that the difference between the calculated conveyance speed and print conveyance speed (target speed) becomes zero. The conveyance speed of the web W is thereby controlled to be constant.

Moreover, the conveyance controller 26 calculates output torque of the conveyance motor 55 corresponding to the current supplied to the conveyance motor 55. The value of the output torque of the conveyance motor 55 corresponding to the supplied current can be calculated from motor characteristics of the conveyance motor 55. The wind-off apparatus controller 13 adjusts the brake force (output torque) of the brake 12 such that the difference between the output torque of the brake 12 and the output torque of the conveyance motor 55 calculated by the conveyance controller 26 becomes a target torque difference corresponding to target tension of the web W. The tension of the web W is thereby controlled to be constant.

When the printing of the images is completed, the ink circulation controller 29 of the printing apparatus terminates the ink circulation operation by the ink circulator 24. Moreover, the wind-off apparatus 2, the printing apparatus 3, and the wind-up apparatus 4 terminate the conveyance of the web W. Specifically, the wind-off apparatus controller 13 stops the brake 12, the conveyance controller 26 of the printing apparatus 3 stops the conveyance motor 55, and the wind-up apparatus controller 93 stops the wind-up motor 92. The series of operations is thereby completed.

As described above, in the printing apparatus 3, the components to be accessed by at least the user or the service man are arranged based on the position and difficulty level of access of each access portion in the housing 32 and on the frequency of access to each component by the user and the service man. This can reduce occurrence of a situation where a component of the printing apparatus 3 to be accessed by the user and the service man is arranged at a position difficult to access. As a result, the convenience in cases where the user and the service man access the components in the housing 32 of the printing apparatus 3 can be improved.

Specifically, in the printing apparatus 3, the components which need to be accessed by the user are arranged at positions suitable for access from the front face 76 of the main body housing 71 or the rear face 83 of the electric component housing 72 with the low difficulty level of access, depending on the difficulty levels of access of the access portions and the frequency of access to these components by the user. The user can thereby easily access the components which need to be accessed, and the convenience for the user is thus improved.

Moreover, the components which need to be accessed by the service man and which are not the access targets of the user are arranged at positions suitable for access from the access portions other than the front face 76 of the main body housing 71 with the lowest difficulty level of access, depending on the difficulty levels of access of the access portions and the frequency of access to the components by the service man. Accordingly, it is possible to suppress unnecessary access to these components by the user while improving the convenience for the service man.

Hence, the printing apparatus 3 can suppress unnecessary access to the components in the housing 32 of the printing apparatus 3 while improving the convenience in cases where the user and the service access the components.

Note that the components arranged based on the positions and difficulty levels of access of the access portions in the housing 32 and the frequency of access to the components by the user and the service man may be some of the components to be accessed by at least the user or the service man. The printing apparatus only needs to be such that at least some of multiple components (components for achieving the functions of the printing apparatus 3) of the apparatus housed in the housing are arranged based on the positions and difficulty levels of access of the access portions and the frequency of access to the components by the user and the service man.

In the aforementioned embodiment, which components of the printing apparatus 3 are to be arranged for each of the access portions with the difficulty levels of access of A to D are determined from the general frequency of access to each of the components of the printing apparatus 3 by the user and the service man. However, the printing apparatus 3 may be configured such that, for example, frequency of access to each of the components of the printing apparatus 3 by the user and service man is obtained through experiments, and which components of the printing apparatus 3 are to be arranged for each of the access portions with the difficulty levels of access of A to D are determined based on the obtained frequency.

Moreover, although the aforementioned embodiment is described by using the printing apparatus 3 which performs printing on the web by using an inkjet method, the printing apparatus may be one using a different printing method and a different print medium.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing apparatus comprising:

a plurality of components for the printing apparatus; and a housing configured to house the plurality of components in an inside of the housing and having a plurality of access portions configured to be accessed during use and servicing of the printing apparatus to access the inside of the housing, wherein the access portions have respective predetermined difficulty levels of access based on a difficulty level of work for accessing the inside of the housing from the respective access portions, at least one or more of the plurality of components housed in the inside of the housing are arranged based on positions and the predetermined difficulty levels of access of the access portions, and a frequency of access to the at least one or more of the plurality of components during the use and the servicing of the printing apparatus, the housing comprises two divided housings divided in a front-rear direction of the printing apparatus, the plurality of access portions include a front face of the housing, a rear face of the housing, a side face of the housing, and an opening-closing portion between the two divided housings, and the predetermined difficulty levels of access for accessing the access portions decrease in an order of the opening-closing portion, the side face, the rear face, and the front face.

2. The printing apparatus according to claim 1, wherein a first component of the plurality of components to be accessed during the use of the printing apparatus is arranged at a position suitable for access from the front face or a position suitable for access from the rear face, depending on the difficulty levels of access of the front face and the rear face and the frequency of access to the first component during the use of the printing apparatus, and a second component of the plurality of components to be accessed during the servicing of the printing apparatus, and not to be accessed during the use of the printing apparatus, is arranged at any one of a position suitable for access from the rear face, a position suitable for access from the side face, and a position suitable for access from the opening-closing portion, depending on the difficulty levels of access of the rear face, the side face, and the opening-closing portion and the frequency of access to the second component to be accessed during the servicing of the printing apparatus.

3. The printing apparatus according to claim 1, wherein a component of the plurality of components to be accessed during the servicing of the printing apparatus, and not to be accessed during the use of the printing apparatus, is arranged at a position suitable for access from the opening-closing portion, and accessing the inside of the housing from the opening-closing portion includes releasing a lock and then opening a space between the two divided housings during the servicing of the printing apparatus.

4. The printing apparatus according to claim 1, wherein a component of the plurality of components to be accessed during the servicing of the printing apparatus, and not to be accessed during the use of the printing apparatus, is arranged at a position suitable for access from the side face, and accessing the inside of the housing from the side face includes removing of the side cover fixed by screws.

5. The printing apparatus according to claim 1, wherein front doors are provided on the front face of the housing and configured to be accessed by an opening operation.

6. The printing apparatus according to claim 1, wherein rear doors are provided on the rear face of the housing and configured to be accessed by an opening operation.

7. The printing apparatus according to claim 1, wherein side covers are provided on the side face of the housing and configured to be accessed by a fastener removal operation.

8. The printing apparatus according to claim 1, wherein an inside space between the dividing housings is configured to be accessed by a lock releasing operation of a lock that maintains the two divided housings is a closed state.

9. The printing apparatus according to claim 1, wherein when the frequency of access for the at least one or more of the plurality of components is high during use of the printing apparatus, the access portions corresponding to the at least one or more of the plurality of components is arranged at a position on the printing apparatus suitable for access from the front face.

10. The printing apparatus according to claim 9, wherein the at least one or more of the plurality of components is a conveyance route of the printing apparatus, and the conveyance route is accessible from the front face.

11. The printing apparatus according to claim 1, wherein when the frequency of access for the at least one or more of the plurality of components is low during use of the printing apparatus, the access portions corresponding to the at least one or more of the plurality of components is arranged at a position on the printing apparatus suitable for access from the rear face.

12. The printing apparatus according to claim 11, wherein the at least one or more of the plurality of components is at least one of a liquid waste storage, components to adjust conveyance speed, and components to adjust response speed of the printing apparatus, and the liquid waste storage, the components to adjust conveyance speed, and the components to adjust response speed are accessible from the rear face.

13. The printing apparatus according to claim 1, wherein when the frequency of access for the at least one or more of the plurality of components is high during servicing of the printing apparatus, the access portions corresponding to the at least one or more of the plurality of components is arranged at a position on the printing apparatus suitable for access from the rear face.

14. The printing apparatus according to claim 13, wherein the at least one or more of the plurality of components are electrical and ink injection testing components, and the electrical and the ink injection testing components are accessible from the rear face.

15. The printing apparatus according to claim 1, wherein when the frequency of access for the at least one or more of the plurality of components is between a high frequency and a low frequency range during servicing of the printing apparatus, the access portions corresponding to the at least one or more of the plurality of components is arranged at a position on the printing apparatus suitable for access from the side face.

16. The printing apparatus according to claim 15, wherein the at least one or more of the plurality of components are ink circulation control components and power supply wiring, and the ink circulation control components and power supply wiring are accessible from the side face.

17. The printing apparatus according to claim 1, wherein when the frequency of access for the at least one or more of the plurality of components is low during servicing of the printing apparatus, the access portions corresponding to the at least one or more of the plurality of components is arranged at a position on the printing apparatus suitable for access from the opening-closing portion.

18. The printing apparatus according to claim 17, wherein the at least one or more of the plurality of components are ink pump components, ink circulation drive components and service power supply components, and the ink pump components, the ink circulation drive components and the service power supply components, are accessible from the opening-closing portion.

* * * * *